US011111098B2

(12) United States Patent
Suzuki et al.

(10) Patent No.: US 11,111,098 B2
(45) Date of Patent: Sep. 7, 2021

(54) SHEET FOLDING SYSTEM AND IMAGE FORMING SYSTEM

(71) Applicants: Michitaka Suzuki, Kanagawa (JP); Tomohiro Furuhashi, Kanagawa (JP); Tomomichi Hoshino, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takahiro Watanabe, Kanagawa (JP); Takuya Morinaga, Tokyo (JP); Yohsuke Haraguchi, Kanagawa (JP)

(72) Inventors: Michitaka Suzuki, Kanagawa (JP); Tomohiro Furuhashi, Kanagawa (JP); Tomomichi Hoshino, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takahiro Watanabe, Kanagawa (JP); Takuya Morinaga, Tokyo (JP); Yohsuke Haraguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 3 days.

(21) Appl. No.: 16/715,608

(22) Filed: Dec. 16, 2019

(65) Prior Publication Data

US 2020/0239265 A1 Jul. 30, 2020

(30) Foreign Application Priority Data

Jan. 30, 2019 (JP) ..... JP2019-014253

(51) Int. Cl.
*B65H 37/06* (2006.01)
*G03G 15/00* (2006.01)

(52) U.S. Cl.
CPC ..... *B65H 37/06* (2013.01); *G03G 15/6582* (2013.01)

(58) Field of Classification Search
CPC ..... B65H 37/06; B65H 29/125; B65H 45/14; B65H 45/04; G03G 15/6582
See application file for complete search history.

(56) References Cited

U.S. PATENT DOCUMENTS 8,366,596 B2 * 2/2013 Hayashi ..... B65H 45/142 493/405
2004/0144221 A1 * 7/2004 Ferrara ..... B65H 45/144 83/13

(Continued)

FOREIGN PATENT DOCUMENTS

JP 1-034848 2/1989
JP 2003-118930 4/2003

(Continued)

*Primary Examiner* — Patrick H Mackey
(74) *Attorney, Agent, or Firm* — Harness, Dickey & Pierce, P.L.C.

(57) ABSTRACT

A sheet folding system includes a plurality of sheet folding apparatuses configured to receive and perform a folding process on a sheet and circuitry configured to distribute sheets to the plurality of sheet folding apparatuses. Each of the plurality of sheet folding apparatuses includes a folding device configured to fold the sheet, a first conveyance passage configured to convey the sheet downstream in a sheet conveyance direction without passing through the folding device, a second conveyance passage configured to convey the sheet to the folding device, a third conveyance passage configured to convey the sheet from the folding device downstream in the sheet conveyance direction, and a junction between the first conveyance passage and the third conveyance passage. The circuitry controls sheet conveyance to prevent an interference, at the junction, between the (Continued)

sheet conveyed from the first conveyance passage and the sheet conveyed from the third conveyance passage.

14 Claims, 10 Drawing Sheets

(56) References Cited

U.S. PATENT DOCUMENTS

| | | | | |
|---|---|---|---|---|
| 2007/0287622 | A1* | 12/2007 | Kato | B65H 37/06 493/424 |
| 2008/0199277 | A1* | 8/2008 | Kato | B65H 37/06 412/11 |
| 2010/0304947 | A1 | 12/2010 | Itou | |
| 2015/0043955 | A1* | 2/2015 | Nishizawa | G03G 15/6582 399/407 |
| 2019/0276263 | A1 | 9/2019 | Hidaka et al. | |
| 2019/0284008 | A1 | 9/2019 | Sakano et al. | |
| 2019/0284009 | A1 | 9/2019 | Suzuki et al. | |
| 2019/0284010 | A1 | 9/2019 | Asami et al. | |
| 2019/0284011 | A1 | 9/2019 | Furuhashi et al. | |
| 2019/0367317 | A1 | 12/2019 | Haraguchi et al. | |

FOREIGN PATENT DOCUMENTS

| | | | | |
|---|---|---|---|---|
| JP | 2006193288 | A | * | 7/2006 |
| JP | 2009173442 | A | * | 8/2009 |
| JP | 2010-275086 | | | 12/2010 |

* cited by examiner

SHEET FOLDING SYSTEM AND IMAGE FORMING SYSTEM

CROSS-REFERENCE TO RELATED APPLICATION

This patent application is based on and claims priority pursuant to 35 U.S.C. § 119(a) to Japanese Patent Application No. 2019-014253, filed on Jan. 30, 2019, in the Japan Patent Office, the entire disclosure of which is hereby incorporated by reference herein.

BACKGROUND

Technical Field

The present disclosure relates to a sheet folding system and an image forming system.

Description of the Related Art

A sheet folding apparatus disposed on the sheet ejection side of an image forming apparatus receives transfer sheets on which image formation has been performed, performs various folding processes such as half fold and Z-fold, and then ejects the sheets or forwards the sheets to a sheet post-processing apparatus disposed on the downstream side.

In this type of sheet folding apparatus, there is a sheet folding apparatus that includes a plurality of rollers arranged therein and is capable of a plurality of folding processes, such as half fold, Z-fold, and double parallel fold, while conveying the transfer sheet between the rollers in different manners. The sheet folding apparatus can perform folding twice or more on a plurality of transfer sheets overlaid one on another.

SUMMARY

An embodiment of this disclosure provides a sheet folding system that includes a plurality of sheet folding apparatuses configured to receive and perform a folding process on a sheet and circuitry configured to distribute sheets to the plurality of sheet folding apparatuses. Each of the plurality of sheet folding apparatuses includes a folding device configured to fold the sheet, a first conveyance passage configured to convey the sheet downstream in a sheet conveyance direction without passing through the folding device, a second conveyance passage configured to convey the sheet to the folding device, a third conveyance passage configured to convey the sheet from the folding device downstream in the sheet conveyance direction, and a junction between the first conveyance passage and the third conveyance passage. The circuitry controls sheet conveyance to prevent an interference, at the junction, between the sheet conveyed from the first conveyance passage and the sheet conveyed from the third conveyance passage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
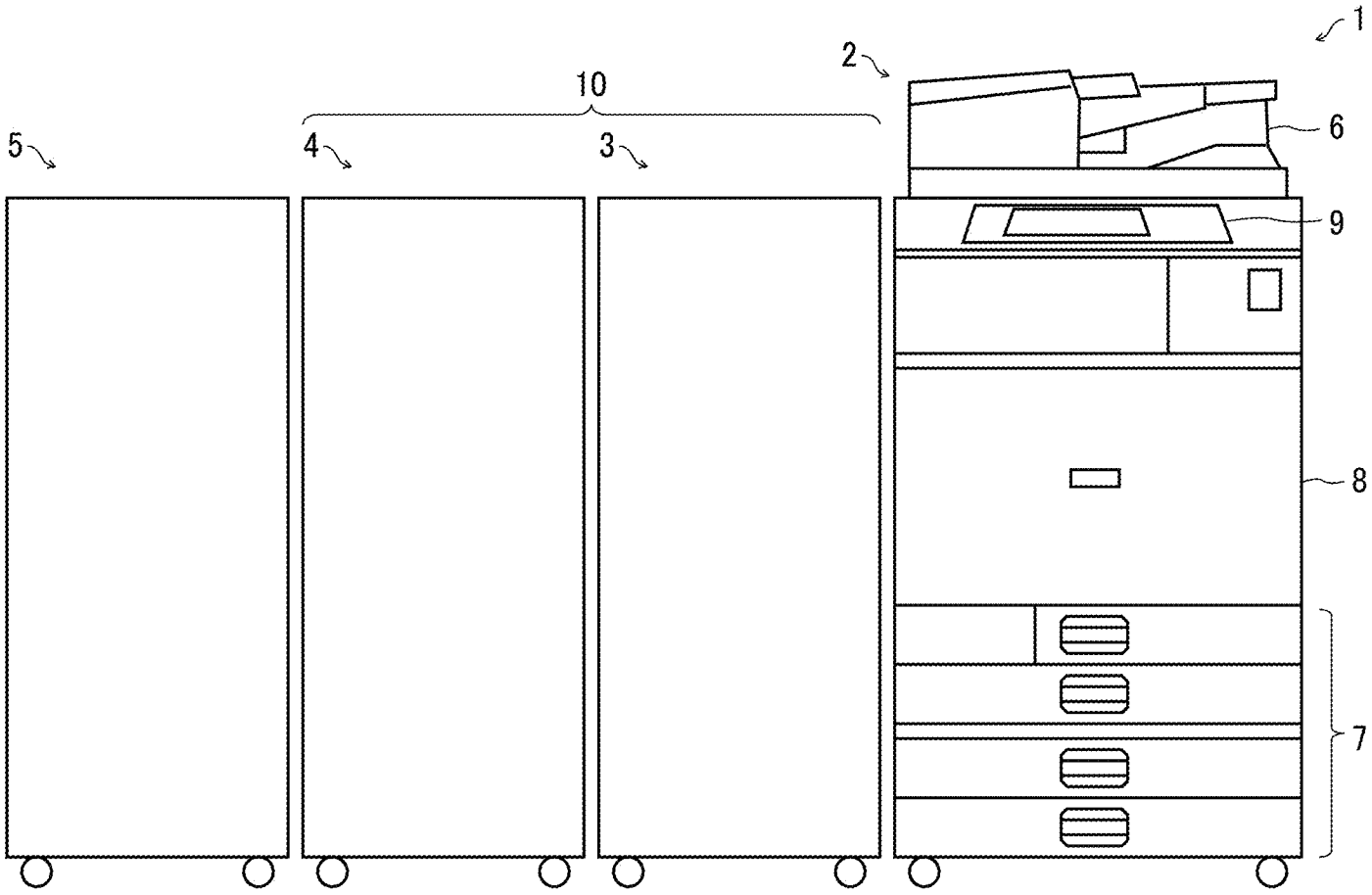
FIG. 1 is a schematic view illustrating a configuration of an image forming system according to one embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an image forming system and a sheet folding system according to embodiments of this disclosure are described. As used herein, the singular forms "a", "an", and "the" are intended to include the plural forms as well, unless the context clearly indicates otherwise.

FIG. 1 illustrates an image forming system including a sheet folding system according to an embodiment of the present disclosure. In FIG. 1, an image forming system 1 mainly includes an image forming apparatus 2, which is a full-color copier, a sheet folding apparatus 3, a sheet folding apparatus 4, and a sheet post-processing apparatus 5.

The image forming apparatus 2 includes a document reading device 6, a sheet feeder 7, an image forming unit 8, a control panel 9, and the like. According to setting set on the control panel 9 and an image of a document read by the document reading device 6, the image forming unit 8 forms an image on a transfer sheet (a sheet), serving as a recording medium, stored in the sheet feeder 7. The transfer sheet on which the image is formed in the image forming apparatus 2 is sent to the subsequent sheet folding apparatus 3.

The sheet folding apparatus 3 and the sheet folding apparatus 4 perform folding processes on the transfer sheet sent from the image forming apparatus 2 and then eject the transfer sheet. In the present embodiment, the sheet folding apparatuses 3 and 4 have the same configuration. In the present embodiment, in a standard sheet folding process in which transfer sheets are not overlaid on each other, a first transfer sheet from the image forming apparatus 2 is sent to the sheet folding apparatus 3, and a second transfer sheet therefrom is sent to the sheet folding apparatus 4. Thereafter, the odd-numbered transfer sheets are conveyed to the sheet folding apparatus 3, and the even-numbered transfer sheets are conveyed to the sheet folding apparatus 4. The sheet folding apparatus 3 and the sheet folding apparatus 4 together construct a sheet folding system 10.

To fold transfer sheets to have multiple folds, such as, half fold and Z-fold, switch-backing the transfer sheets is necessary to perform folding process multiple number of times. Accordingly, depending on the type of folding, intervals for switchback are required between the transfer sheets, and productivity is lowered. When two ore more sheet folding apparatuses are coupled to each other and the transfer sheets are distributed thereto, the sheet folding apparatuses perform folding processes respectively. Thus, the number of folding methods increases, and processing time can be reduced.

The sheet post-processing apparatus 5 performs post-processing such as sorting and stapling on the transfer sheets that have passed through the sheet folding system 10.

Figure 2:
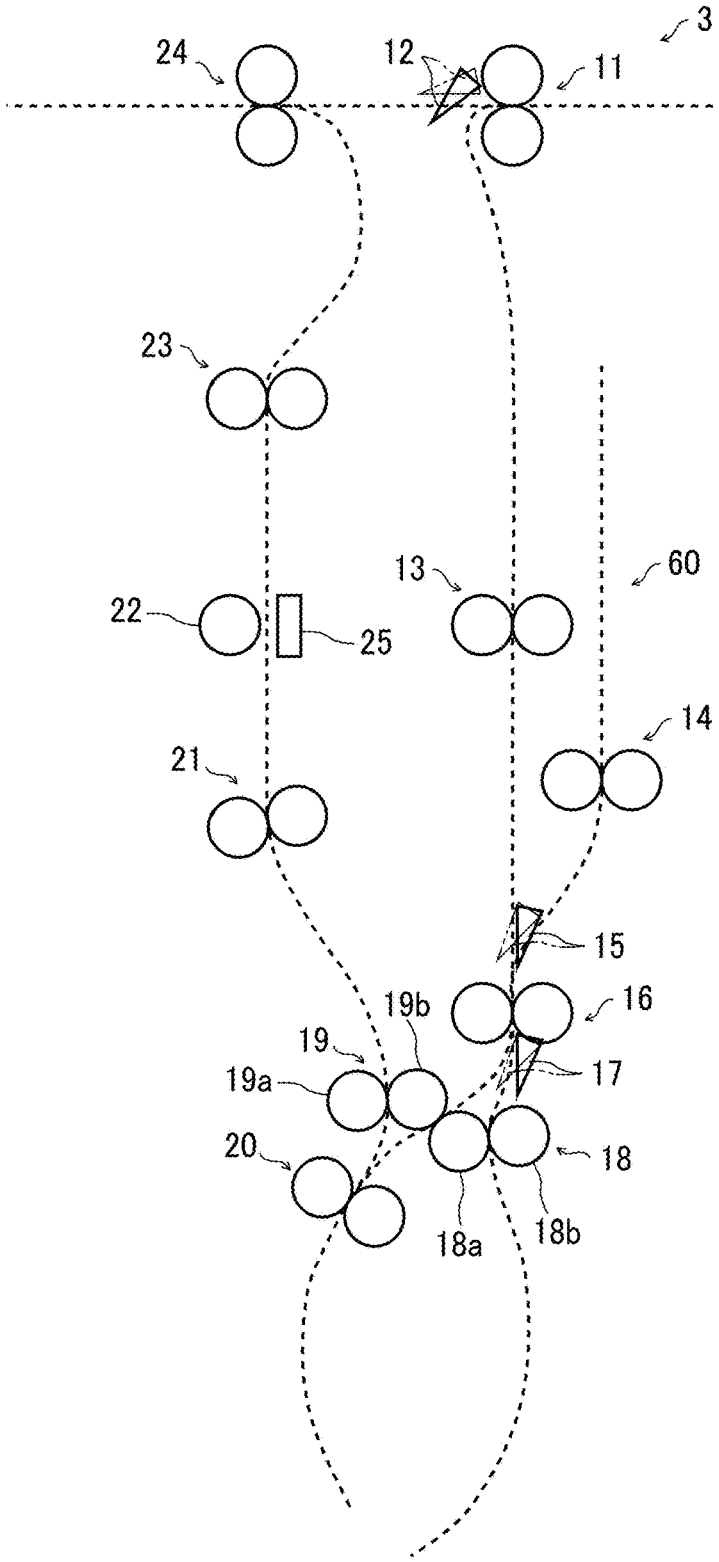
FIG. 2 is a schematic view illustrating a configuration of a sheet folding apparatus according to one embodiment of the present disclosure.

FIG. 2 illustrates a configuration of the sheet folding apparatus 3. The sheet folding apparatus 3 includes a carrying-in roller pair 11, a first bifurcating claw 12, a conveyance roller pair 13, a drawing-in roller pair 14, a second bifurcating claw 15, a registration roller pair 16, a third bifurcating claw 17, and first and second folding roller pairs 18 and 19 serving as folding devices. The sheet folding apparatus 3 further includes a drawing-in roller pair 20, a conveyance roller pair 21, a fold-enforcing roller 22 serving as a fold-enforcing device, a conveyance roller pair 23, and an ejection roller pair 24.

The carrying-in roller pair 11 receives the transfer sheet from the image forming apparatus 2 and conveys the transfer sheet to the downstream side in a sheet conveyance direction. The first bifurcating claw 12 is disposed downstream from the carrying-in roller pair 11 and selectively occupies a first position and a second position. When the first bifurcating claw 12 occupies the first position indicated by the solid line in FIG. 2, the transfer sheet conveyed by the carrying-in roller pair 11 is guided downward in FIG. 2 and forwarded to the conveyance roller pair 13. When the first bifurcating claw 12 occupies the second position indicated by a two-dot chain line in FIG. 2, the transfer sheet conveyed by the carrying-in roller pair 11 is guided leftward in FIG. 2 and forwarded to the ejection roller pair 24.

The conveyance roller pair 13 conveys the received transfer sheet downward in FIG. 2. Disposed downstream from the conveyance roller pair 13 is the second bifurcating claw 15 that selectively occupies a first position and a second position. When the second bifurcating claw 15 occupies the first position indicated by the solid line in FIG. 2, the transfer sheet conveyed by the conveyance roller pair 13 is guided downward in FIG. 2 to the registration roller pair 16. When the second bifurcating claw 15 occupies the second position indicated by the two-dot chain line in FIG. 2, the sheet conveyance passage to the drawing-in roller pair 14 is opened. As the registration roller pair 16 nipping the transfer sheet rotates in reverse to the direction for normal conveyance, the transfer sheet is received by the drawing-in roller pair 14 and sent to a drawing-in passage 60.

The registration roller pair 16 temporarily stops the transfer sheet and conveys the transfer sheet to the downstream side at a predetermined timing.

The third bifurcating claw 17 that selectively occupies a first position and a second position is disposed downstream from the registration roller pair 16. The first folding roller pair 18 is below the third bifurcating claw 17, and the second folding roller pair 19 is on the left side thereof. The first folding roller pair 18 is constructed of a drive roller 18*a* and a driven roller 18*b*. The second folding roller pair 19 is constructed of a drive roller 19*a* and a driven roller 19*b*.

When the third bifurcating claw 17 occupies the first position indicated by the solid line in FIG. 2, the transfer sheet sent from the registration roller pair 16 is nipped between the drive roller 18*a* and the driven roller 18*b* and is conveyed in the direction directly below in FIG. 2. When the third bifurcating claw 17 occupies the second position indicated by the chain double-dashed line in FIG. 2, the transfer sheet sent from the registration roller pair 16 is nipped between the drive roller 18*a* and the driven roller 19*b*. The transfer sheet is conveyed in the direction lower left in FIG. 2 and nipped by the drawing-in roller pair 20.

When the drive roller 19*a* rotates in reverse with the transfer sheet nipped by the drawing-in roller pair 20, the transfer sheet is conveyed upward in FIG. 2. The conveyance roller pair 21 further conveys the transfer sheet upward. The fold-enforcing roller 22 is disposed downstream from the conveyance roller pair 21. A description of the fold-enforcing roller 22 is deferred.

The conveyance roller pair 23 as a sheet conveyor is disposed downstream from the fold-enforcing roller 22. Further, the ejection roller pair 24 is disposed on the downstream side thereof. After the fold thereof is enforced by the fold-enforcing roller 22, the transfer sheet is conveyed, via the conveyance roller pair 23 and the ejection roller pair 24, to the sheet folding apparatus 4 disposed downstream from the sheet folding apparatus 3. The sheet folding apparatus 4 has the similar configuration to the sheet folding apparatus 3, and a description of the sheet folding apparatus 4 is deferred.

Figure 3:
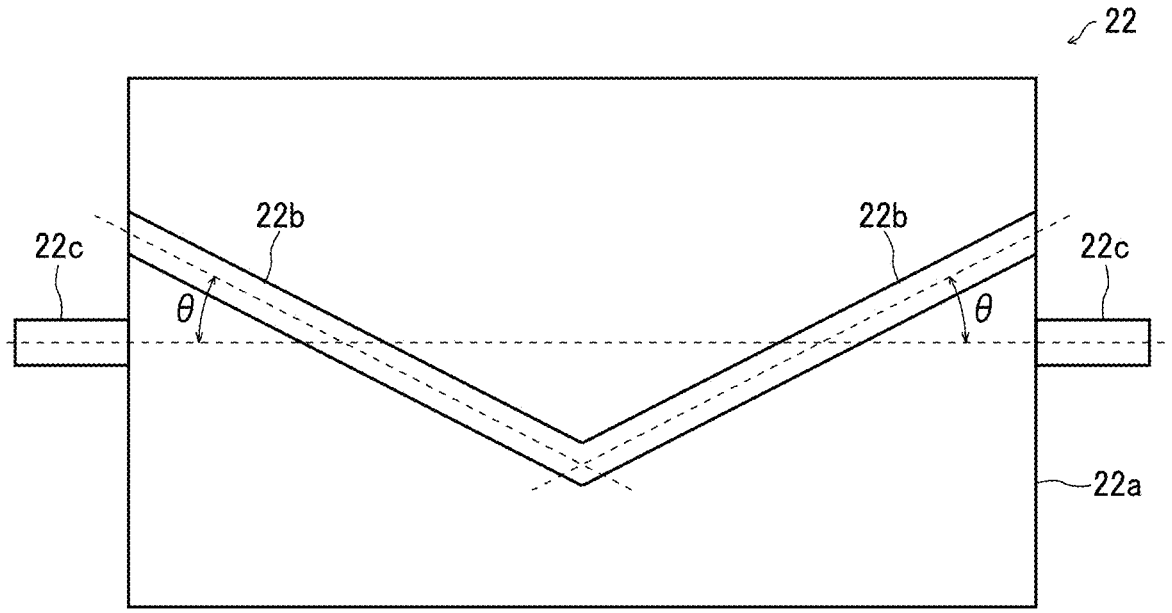
FIG. 3 is a schematic view of a fold-enforcing roller used in one embodiment of the present disclosure.

As illustrated in FIG. 3, the fold-enforcing roller 22 includes projecting lines 22*b* as protrusions disposed on the peripheral surface of a roller body 22*a*. The projecting lines 22*b* are arranged at an angle θ with a support shaft 22*c* and in line-symmetry in the width direction of the roller body 22*a* with respect to a center in the width direction. Use of the fold-enforcing roller 22 having such a configuration can increase the efficiency of fold enforcing since portions of the projecting lines 22*b* can simultaneously contact the fold on the transfer sheet at two locations.

Figure 4:
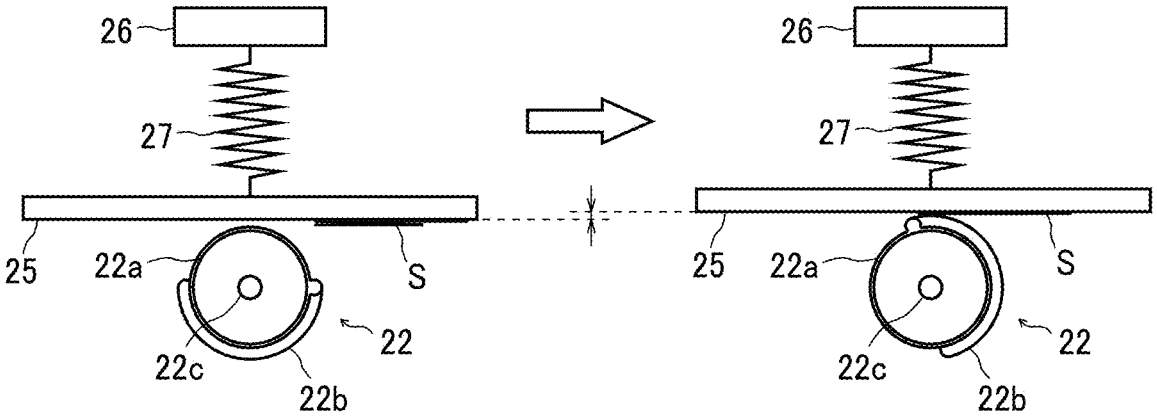
FIG. 4 is a schematic view of a sheet support plate used in one embodiment of the present disclosure.

As illustrated in FIG. 4, a sheet support plate 25 that supports the conveyance of a transfer sheet S is disposed opposite the fold-enforcing roller 22 via the sheet conveyance passage. The sheet support plate 25 is provided with a compression spring 27 having one end fixed to a fixed member 26 fixed to the body of the sheet folding apparatus 3. The other end of the compression spring 27 is attached to the sheet support plate 25 to urge the sheet support plate 25 toward the fold-enforcing roller 22. With this configuration, when the projecting lines 22*b* contact the sheet support plate 25, the sheet support plate 25 is displaced. Then, the sheet support plate 25 is pressed against the projecting lines 22*b* by the urging force of the compression spring 27, and the fold on the transfer sheet S is enforced.

Next, a description is given of a Z-fold operation for forming a Z-fold on the transfer sheet using the sheet folding apparatus 3, with reference to FIGS. 5A to 5D.

First, the carrying-in roller pair 11 introduces the transfer sheet S bearing an image formed in the image forming apparatus 2 into the sheet folding apparatus 3. Then, the first bifurcating claw 12 at the first position guides the transfer sheet S to the conveyance roller pair 13. The transfer sheet S conveyed by the conveyance roller pair 13 is guided by the second bifurcating claw 15 occupying the first position and is forwarded to the registration roller pair 16.

The transfer sheet S that has reached the registration roller pair 16 is guided by the third bifurcating claw 17 at the first position and is conveyed downward while being nipped between the drive roller 18*a* and the driven roller 18*b* rotating in the forward direction. When the transfer sheet S is conveyed downward by a predetermined amount from the nipping position of the drive roller 18*a* and the driven roller 18*b*, the drive roller 18*a* rotates in reverse, and the transfer sheet S is bent between the registration roller pair 16 and the first folding roller pair 18. The bent portion is conveyed by the drive roller 18*a* rotating in reverse and is nipped between the drive roller 18*a* and the driven roller 19*b*. Thus, the first folding process is performed as illustrated in FIG. 5A.

Figure 5A:
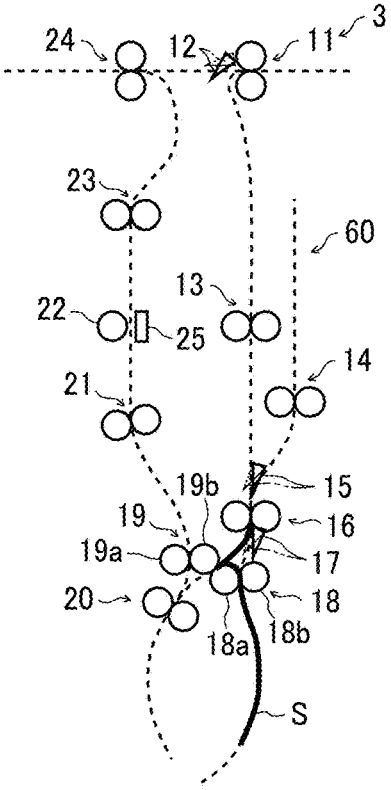
FIGS. 5A to 5D are schematic views illustrating a Z-fold operation on a transfer sheet by the sheet folding apparatus according to one embodiment of the present disclosure.

After the first folding process is performed thereon, the transfer sheet S is nipped between the drive roller 18*a* and the driven roller 19*b* and conveyed to the lower left in FIG. 5A. Then, the fold on the transfer sheet S is nipped by the drawing-in roller pair 20 rotating in the forward direction. As the drawing-in roller pair 20 rotates, the fold of the transfer sheet S is nipped therein and conveyed. When the overlapping portion (in double) of the transfer sheet S is conveyed to a predetermined position upstream from the drawing-in roller pair 20, the drawing-in roller pair 20 rotates in reverse.

When the drawing-in roller pair 20 is reversed, the transfer sheet S is bent in a portion between the second folding roller pair 19 and the drawing-in roller pair 20. Then, the bent portion is nipped by the second folding roller pair 19 as illustrated in FIG. 5B.

Figure 5B:
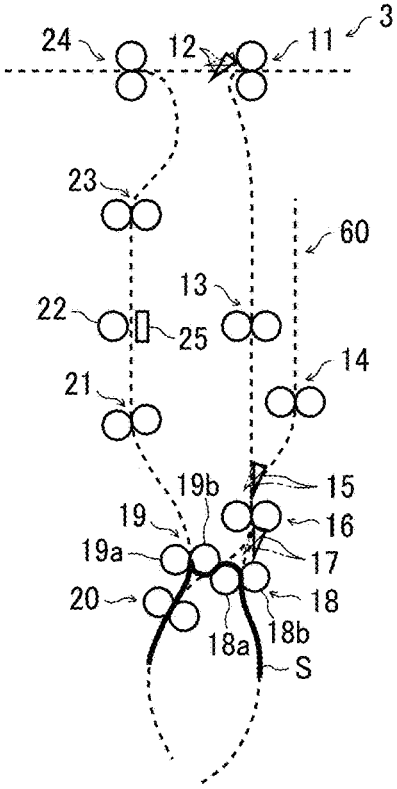
Figure 5C:
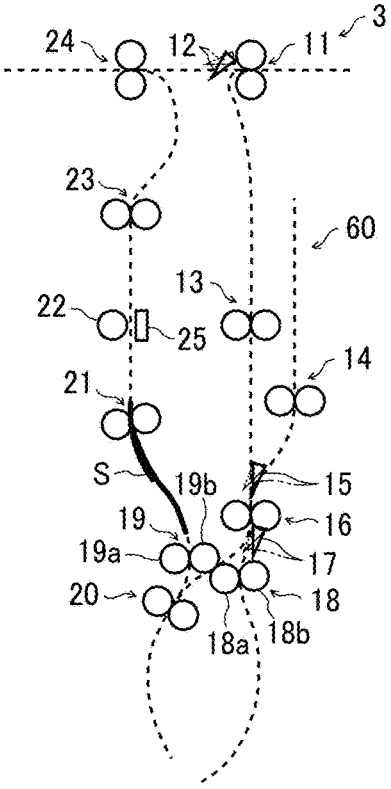
Figure 5D:
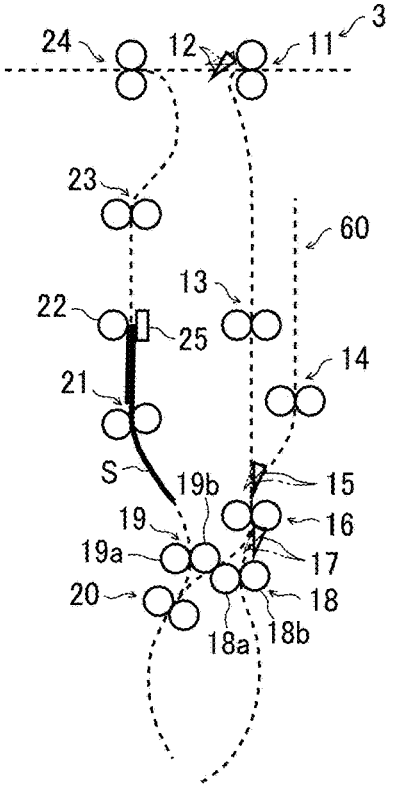

When the transfer sheet S is nipped by the second folding roller pair 19, the drive roller 19*a* starts rotating counter-clockwise in FIG. 5B, and the drive roller 18*a* stops rotating. The transfer sheet S nipped by the second folding roller pair 19 is conveyed upward, and the second folding process is performed. The transfer sheet S on which the second folding process has performed and the Z-folding process has completed is sent to the conveyance roller pair 21 as illustrated in FIG. 5C. Then, as illustrated in FIG. 5D, the transfer sheet S is sent to the fold-enforcing roller 22 and subjected to a fold-enforcing process.

The transfer sheet S subjected to fold-enforcing is sent further upward by the conveyance roller pair 23 and is ejected from the sheet folding apparatus 3 by the ejection roller pair 24. With this series of operations, the Z-fold operation on the transfer sheet S by the sheet folding apparatus 3 is completed.

Figure 6:
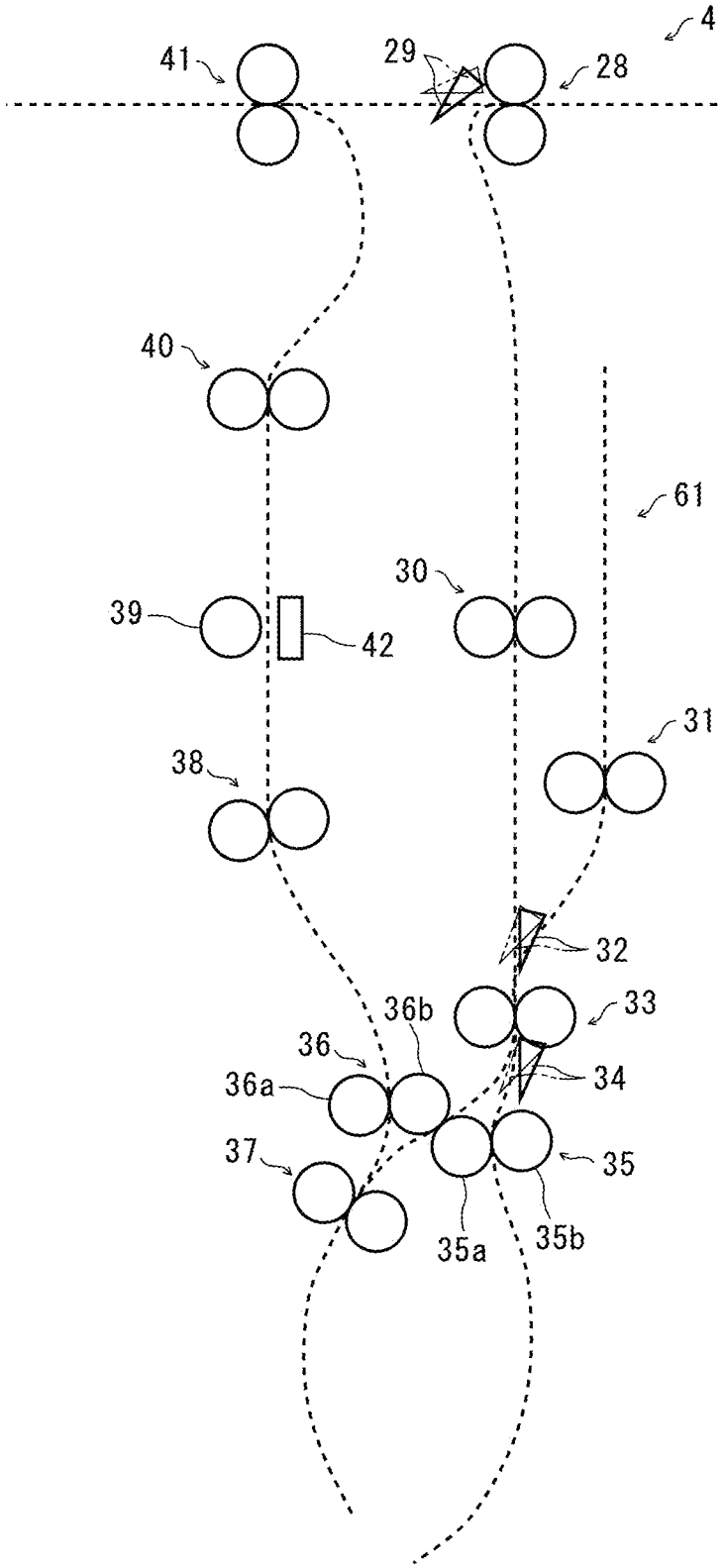
FIG. 6 is a schematic view illustrating a configuration of another sheet folding apparatus according to one embodiment of the present disclosure.

FIG. 6 illustrates a configuration of the sheet folding apparatus 4. The sheet folding apparatus 4 includes a carrying-in roller pair 28, a first bifurcating claw 29, a conveyance roller pair 30, a drawing-in roller pair 31, a second bifurcating claw 32, a registration roller pair 33, a third bifurcating claw 34, and first and second folding roller pairs 35 and 36 serving as folding devices. The sheet folding apparatus 4 further includes a drawing-in roller pair 37, a conveyance roller pair 38, a fold-enforcing roller 39 as a fold-enforcing device, a conveyance roller pair 40, and an ejection roller pair 41.

The carrying-in roller pair 28 receives the transfer sheet from the sheet folding apparatus 3 and conveys the transfer sheet to the downstream side in a sheet conveyance direction. The first bifurcating claw 29 is disposed downstream from the carrying-in roller pair 28 and selectively occupies a first position and a second position. When the first bifurcating claw 29 occupies the first position indicated by the solid line in FIG. 6, the transfer sheet conveyed by the carrying-in roller pair 28 is guided downward in FIG. 6 and forwarded to the conveyance roller pair 30. When the first bifurcating claw 29 occupies the second position indicated by a two-dot chain line in FIG. 6, the transfer sheet conveyed by the carrying-in roller pair 28 is guided leftward in FIG. 6 and forwarded to the ejection roller pair 41.

The conveyance roller pair 30 conveys the received transfer sheet downward in FIG. 6. Disposed downstream from the conveyance roller pair 30 is the second bifurcating claw 32 that selectively occupies a first position and a second position. When the second bifurcating claw 32 occupies the first position indicated by the solid line in FIG. 6, the transfer sheet conveyed by the conveyance roller pair 30 is guided downward in FIG. 6 to the registration roller pair 33. When the second bifurcating claw 32 occupies the second position indicated by the two-dot chain line in FIG. 6, the sheet conveyance passage to the drawing-in roller pair 31 is opened. As the registration roller pair 33 nipping the transfer sheet rotates in reverse to the direction for normal conveyance, the transfer sheet is received by the drawing-in roller pair 31 and sent to a drawing-in passage 61.

The third bifurcating claw 34 that selectively occupies a first position and a second position is disposed downstream from the registration roller pair 33. The first folding roller pair 35 is below the third bifurcating claw 17, and the second folding roller pair 36 is on the left side thereof. The first folding roller pair 35 is constructed of a drive roller 35*a* and a driven roller 35*b*. The second folding roller pair 36 is constructed of a drive roller 36*a* and a driven roller 36*b*.

When the third bifurcating claw 34 occupies the first position indicated by the solid line in FIG. 6, the transfer sheet sent from the registration roller pair 33 is nipped between the drive roller 35*a* and the driven roller 35*b* and is conveyed in the direction directly below in FIG. 6. When the third bifurcating claw 34 occupies the second position indicated by the chain double-dashed line in FIG. 6, the transfer sheet sent from the registration roller pair 33 is nipped between the drive roller 35*a* and the driven roller 36*b*. The transfer sheet is conveyed in the direction lower left in FIG. 6 and nipped by the drawing-in roller pair 37.

When the drive roller 36*a* rotates in reverse with the transfer sheet nipped by the drawing-in roller pair 37, the transfer sheet is conveyed upward in FIG. 6. The conveyance roller pair 38 further conveys the transfer sheet upward. The fold-enforcing roller 39 is disposed downstream from the conveyance roller pair 38. The fold-enforcing roller 39 has a configuration similar to that of the fold-enforcing roller 22 described above. At a position opposite the fold-enforcing roller 39 via the sheet conveyance passage, a sheet support plate 42 having a configuration similar to that of the above-described sheet support plate 25 is disposed.

The conveyance roller pair 40 as a sheet conveyor is disposed downstream from the fold-enforcing roller 39. Further, the ejection roller pair 41 is disposed on the downstream side thereof. After the fold thereof is enforced by the fold-enforcing roller 39, the transfer sheet is conveyed, via the conveyance roller pair 40 and the ejection roller pair 41, to the sheet post-processing apparatus 5 disposed downstream from the sheet folding apparatus 4.

Figure 7:
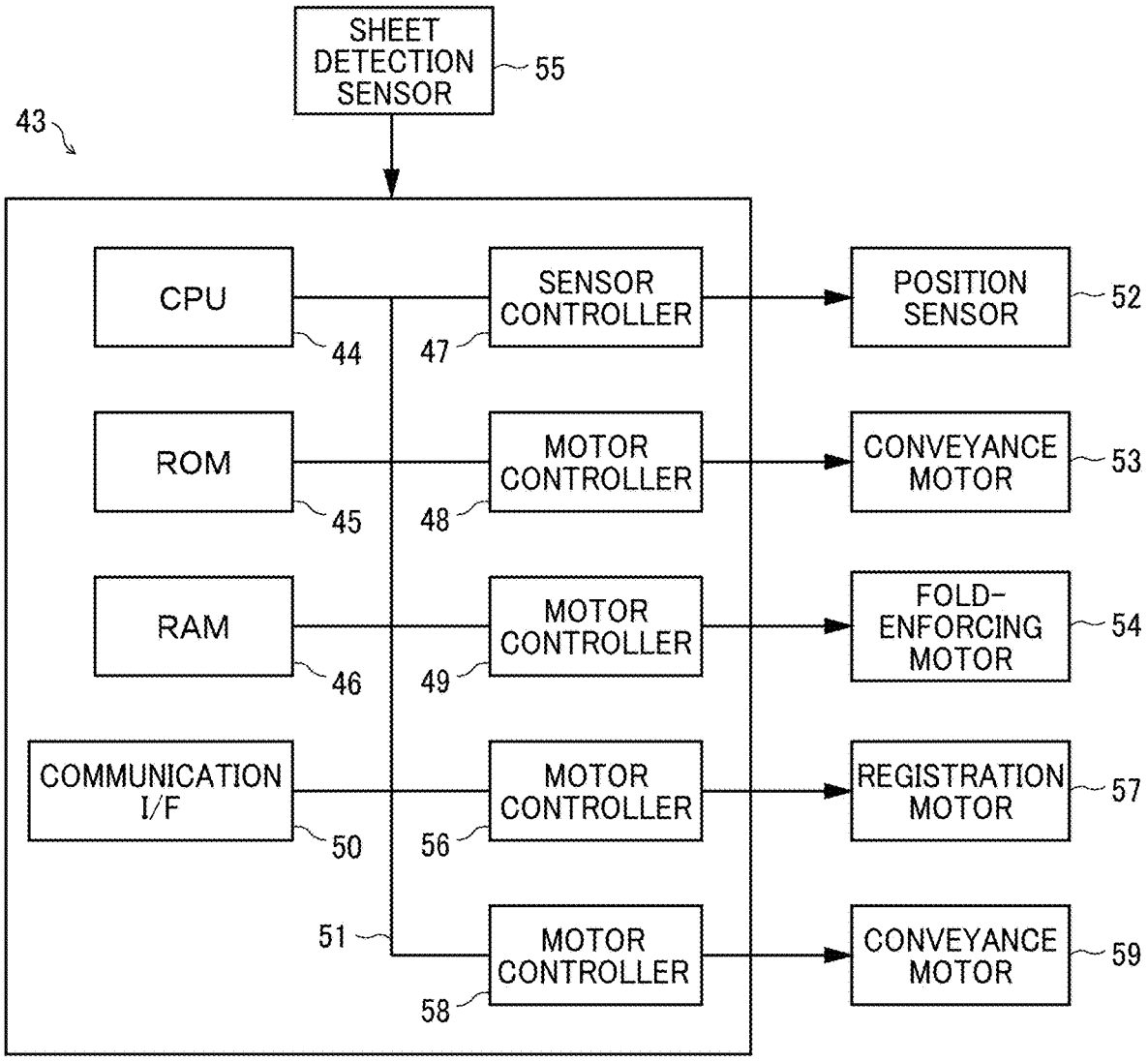
FIG. 7 is a block diagram illustrating a configuration of a controller according to one embodiment of the present disclosure.

FIG. 7 is a block diagram illustrating a configuration of a controller 43 that controls the operation of the sheet folding apparatus 3. The controller 43 illustrated in FIG. 7 includes a central processing unit (CPU) 44, a read only memory (ROM) 45, a random access memory (RAM) 46, a sensor controller 47, motor controllers 48, 49, 56, and 58, and a communication interface 50. These components are mutually and electrically connected via a bus line 51 such as an address bus or a data bus.

The CPU 44 executes a program stored in the ROM 45, thereby controlling the operation of the sheet folding apparatus 3. The ROM 45 stores data and programs executed by the CPU 44. The RAM 46 temporarily stores data and the like when the CPU 44 executes the programs.

The communication interface 50 communicates with the image forming apparatus 2, the sheet folding apparatus 4, and the sheet post-processing apparatus 5, and exchanges data necessary for controlling the operation. The sensor controller 47 is connected to a position sensor 52 disposed on the fold-enforcing roller 22 and monitors the detection of the transfer sheet. The motor controller 48 controls the conveyance motor 53 that drives the conveyance roller pair 13. The motor controller 49 controls the fold-enforcing motor 54 that rotates the fold-enforcing roller 22. The motor controller 56 controls the registration motor 57 that drives the registration roller pair 16. The motor controller 58 controls the conveyance motor 59 that drives the conveyance roller pair 21.

The sheet folding apparatus 4 is provided with a controller similar to the controller 43.

Figure 8:
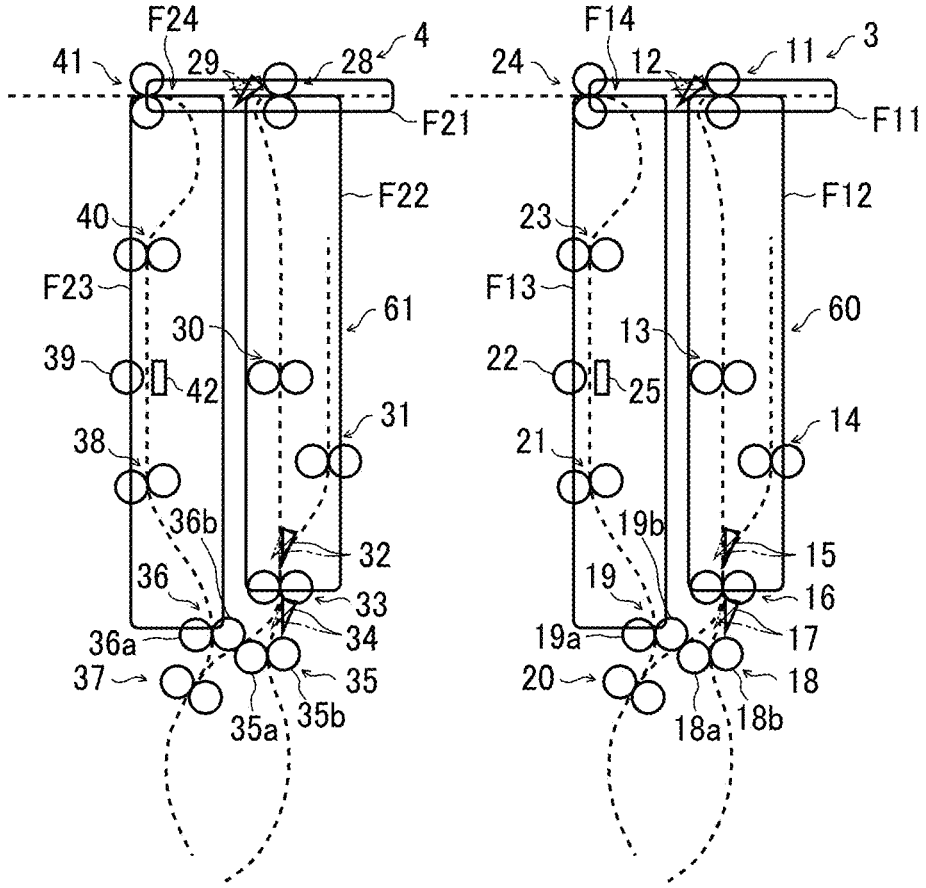
FIG. 8 is a schematic view illustrating a sheet conveyance passage in each sheet folding apparatus used in one embodiment of the present disclosure.

FIG. 8 is a cross-sectional view illustrating the sheet conveyance passages in the sheet folding apparatuses 3 and 4.

The carrying-in roller pair 11 conveys the transfer sheet sent from the image forming apparatus 2. When the folding process is not to be performed, the first bifurcating claw 12 guides the transfer sheet to a first conveyance passage F11. When the folding process is to be performed, the first bifurcating claw 12 guides the transfer sheet to a second conveyance passage F12. The folding process is performed by the first folding roller pair 18 and the second folding roller pair 19 as described above. The transfer sheet that has been folded is conveyed upward in FIG. 8, and the fold-enforcing roller 22 performs additional folding to enforce the fold. Then, the transfer sheet is conveyed through a third conveyance passage F13 by the conveyance roller pair 23, passes through a junction F14 between the first conveyance passage F11 and the third conveyance passage F13, and is sent to the sheet folding apparatus 4.

The carrying-in roller pair 28 conveys the transfer sheet sent from the sheet folding apparatus 3. When the folding process is not to be performed, the first bifurcating claw 29 guides the transfer sheet to a first conveyance passage F21. When the folding process is to be performed, the first bifurcating claw 29 guides the transfer sheet to a second conveyance passage F22. Similar to the sheet folding apparatus 3, the folding process is performed by the first folding roller pair 35 and the second folding roller pair 36. The transfer sheet that has been folded is conveyed upward in FIG. 8, and the fold-enforcing roller 39 performs additional folding to enforce the fold. Then, the transfer sheet is conveyed through a third conveyance passage F23 by the conveyance roller pair 40, passes through a junction F24 between the first conveyance passage F21 and the third conveyance passage F23, and is sent to the sheet post-processing apparatus 5.

In the sheet folding system 10 including the two sheet folding apparatuses 3 and 4 arranged in succession as described above, the productivity of folding can be most improved when the transfer sheets are folded alternately in the sheet folding apparatuses 3 and 4. In other words, as described above, the first transfer sheet from the image forming apparatus 2 is conveyed to the sheet folding apparatus 3, and the second transfer sheet therefrom is conveyed to the sheet folding apparatus 4. Thereafter, the odd-numbered transfer sheets are conveyed to the sheet folding apparatus 3, and the even-numbered transfer sheets are conveyed to the sheet folding apparatus 4. The odd-numbered transfer sheets and even-numbered transfer sheets are folded in the sheet folding apparatuses 3 and 4, respectively. Note that odd-numbered transfer sheets may be conveyed to the sheet folding apparatus 4 and even-numbered transfer sheets may be conveyed to the sheet folding apparatus 3.

When performing such a folding operation, the following defective conveyance may occur. That is, the transfer sheet conveyed from the first conveyance passage F11 may interfere with the transfer sheet conveyed from the third conveyance passages F13 at the junction F14 in the sheet folding apparatus 3. Similarly, the transfer sheet conveyed from the first conveyance passage F21 may interfere with the transfer sheet conveyed from the third conveyance passages F23 at the junction F24 in the sheet folding apparatus 4. Therefore, according to an aspect of the present disclosure, sheet conveyance is controlled to prevent the interference between transfer sheets in the junctions F14 and F24, to prevent detective sheet conveyance. The control method is described below.

When the folding of the transfer sheets is alternately performed in the sheet folding apparatuses 3 and 4, it is necessary to avoid the collision of the transfer sheets at the junctions F14 and F24 described above. Therefore, in the present embodiment, each of the sheet folding apparatuses 3 and 4 includes a sheet retainer to temporarily retain the transfer sheet, and the sheet conveyance is controlled to prevent collision of the transfer sheets at the junctions F14 and F24.

Figure 9A:
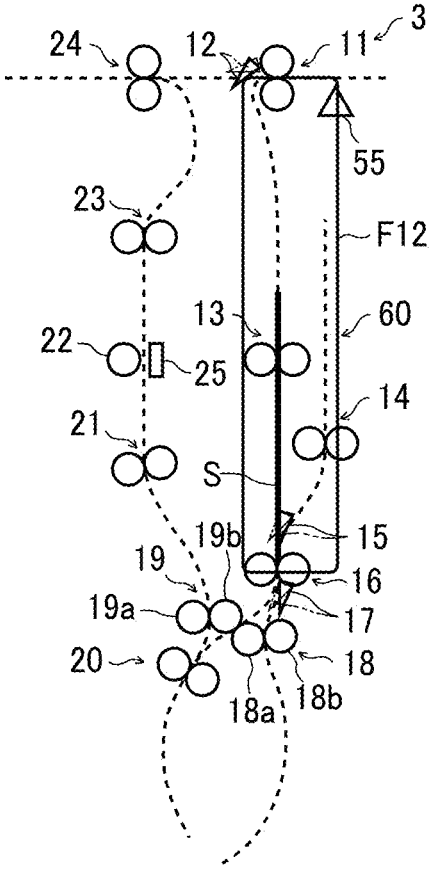
FIGS. 9A and 9B are schematic views illustrating sheet conveyance control according to one embodiment of the present disclosure.

In the present embodiment, as illustrated in FIG. 9A, the transfer sheet S is temporarily retained at a position where the leading end of the transfer sheet S contacts the registration roller pair 16. That is, the registration roller pair 16 located in the second conveyance passage F12 functions as a first retainer. Similarly, in the sheet folding apparatus 4, the registration roller pair 33 located in the second conveyance passage F22 functions as a first retainer.

Figure 9B:
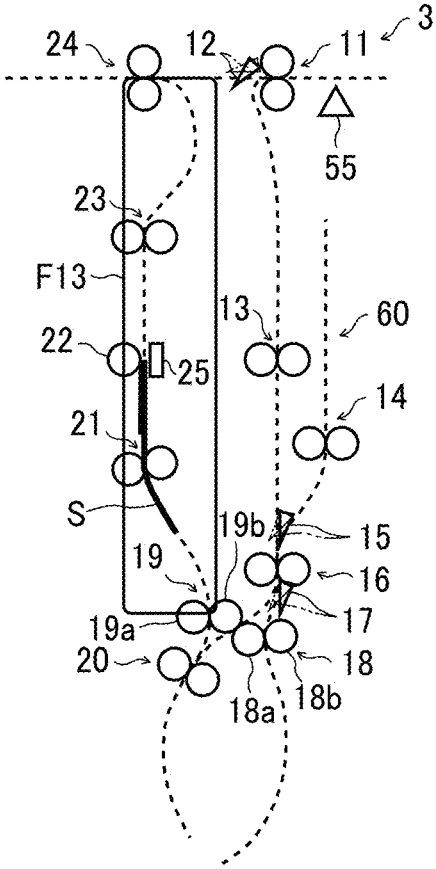

Further, in the present embodiment, as illustrated in FIG. 9B, the transfer sheet S is temporarily retained at a position where the leading end of the transfer sheet S is in contact with the fold-enforcing roller 22. That is, the fold-enforcing roller 22 located in the third conveyance passage F13 functions as a second retainer. Similarly, in the sheet folding apparatus 4, the fold-enforcing roller 39 located in the third conveyance passage F23 functions as a second retainer.

Next, the conveyance start timing of the transfer sheet S from the first and second retainers (the registration roller pair 16 and the fold-enforcing roller 22) is described with reference to FIGS. 10A and 10B. In the present embodiment, in order to control the transfer start timing of the transfer sheet S being retained by the retainers (the registration roller pair 16 and the fold-enforcing roller 22), a sheet detection sensor 55 as a sheet detector is disposed upstream from the carrying-in roller pair 11 in the sheet conveyance direction. As illustrated in FIG. 7, in response to a detection signal from the sheet detection sensor 55, the controller 43 controls the registration motor 57 that drives the registration roller pair 16 and the fold-enforcing motor 54 that drives the fold-enforcing roller 22.

Figure 10A:
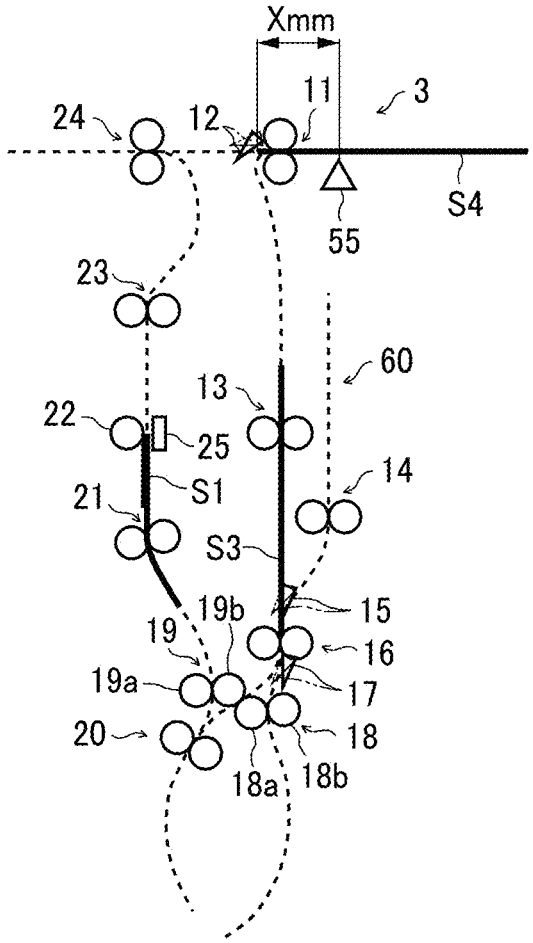
FIGS. 10A and 10B are schematic views illustrating sheet conveyance control according to one embodiment of the present disclosure.
Figure 10B:
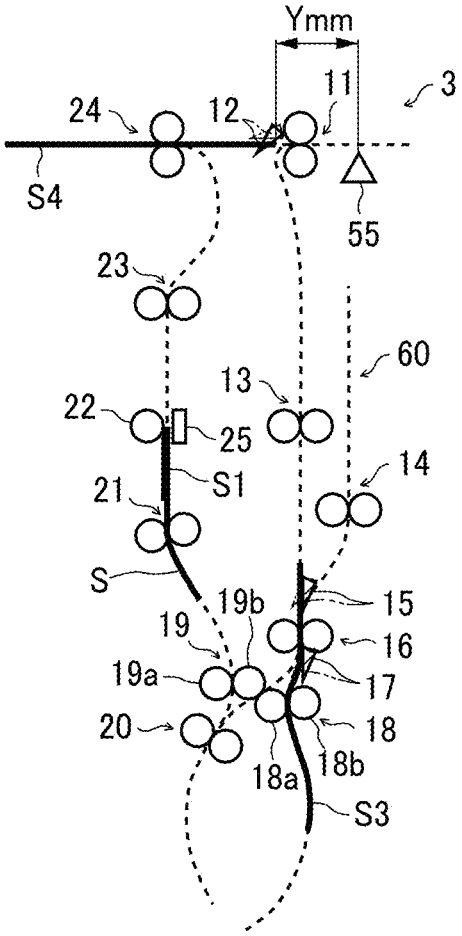

In FIG. 10A, the leading end of a first transfer sheet 51 from the image forming apparatus 2 is brought into contact with and retained by the fold-enforcing roller 22, serving as the second retainer, in a Z-folded state by the above-described procedure. A second transfer sheet is sent to the sheet folding apparatus 4. When the leading end of a third transfer sheet S3 reaches the registration roller pair 16 as the first retainer from this state, the controller 43 controls the conveyance motor 53 to stop the conveyance roller pair 13. After a fourth transfer sheet S4 sent to the sheet folding apparatus 4 from the image forming apparatus 2 is conveyed by a predetermined distance X mm from when the sheet detection sensor 55 detects the leading end thereof, the controller 43 operates the registration motor 57 to drive the registration roller pair 16.

After the registration roller pair 16 is driven, when the trailing end of the transfer sheet S4 is conveyed by a predetermined distance Y mm from when the trailing end passes by the sheet detection sensor 55, the controller 43 operates the fold-enforcing motor 54 to drive the fold-enforcing roller 22. The transfer sheet 51 whose fold has been enforced by the fold-enforcing roller 22 is sent to the sheet folding apparatus 4 via the conveyance roller pair 23 and the ejection roller pair 24.

The transfer sheet S3 conveyed downward by the registration roller pair 16 is Z-folded by the same method as described above and conveyed to the fold-enforcing roller 22. When the controller 43 determines that the leading end of the transfer sheet S3 conveyed to the fold-enforcing roller 22 has reached a predetermined position based on a signal from the position sensor 52, the controller 43 controls the conveyance motor 59 to stop the conveyance roller pair 21. Then, the transfer sheet S3 is retained at the position of the fold-enforcing roller 22.

In the sheet folding apparatus 4, the carrying-in roller pair 28 receives the transfer sheet S4 from the sheet folding apparatus 3. The transfer sheet S4 is guided to the first bifurcating claw 29, sent to the registration roller pair 33, and retained there. After the sheet detection sensor (similar to the sheet detection sensor 55) detects the leading end of the folded transfer sheet S1 sent from the sheet folding apparatus 3, the folded transfer sheet S1 is conveyed by the predetermined distance X mm. At that time, the registration roller pair 33 is driven, and the Z-folding process is performed on the transfer sheet S4.

After the sheet detection sensor (similar to the sheet detection sensor 55) in the sheet folding apparatus 4 detects the trailing end of the transfer sheet S1, the transfer sheet S1 is conveyed by the predetermined distance Y mm. At that time, the fold-enforcing roller 39 is driven, and the fold of the transfer sheet S2 retained at the fold-enforcing roller 39 is enforced. The transfer sheet S2 whose fold has been enforced by the fold-enforcing roller 39 is sent to the sheet post-processing apparatus 5 via the conveyance roller pair 40 and the ejection roller pair 41. Thereafter, this operation is repeated.

The retaining operation described above can be deceleration not full stop of conveyance. Although the fold-enforcing rollers 22 and 39 function as the second retainers in the above-described embodiment, the second retainers are not limited thereto. Alternatively, for example, the conveyance roller pairs 23 and 40, located extreme downstream respectively in the third conveyance passages F13 and F23, can function as the second retainers. In this case, the controller 43 performs the retaining operation in a state where the transfer sheets S are held by the conveyance roller pairs 23 and 40.

With the above-described configuration, in the sheet folding system 10 according to the present disclosure, the controller 43 controls conveyance of the transfer sheet to prevent interference between the transfer sheets conveyed from the first conveyance passages F11 and F21 and the transfer sheets conveyed from the third conveyance passages F13 and F23, respectively, in the junctions F14 and F24. Accordingly, the sheet folding system 10 can improve productivity while preventing the occurrence of defective conveyance.

In addition, since the controller 43 causes at least one of the first retainers (the registration roller pairs 16 and 33) and the second retainers (the fold-enforcing rollers 22 and 39) to temporarily retain the transfer sheets, the controller 43 can prevent the occurrence of defective conveyance.

Further, the controller 43 cancels the retention by the retainers (the registration roller pairs 16 and 33 and the fold-enforcing rollers 22 and 39) in response to the signal from the sheet detection sensor 55. Accordingly, the operation can be reliably controlled with a simple configuration. There are sheet folding apparatuses already equipped with the sheet detection sensor 55. In this case, the above-described control can be performed without adding the sensor, and cost can be reduced.

In the above-described embodiment, the fold-enforcing rollers 22 and 39 are used as the second retainer, and the transfer sheets are retained when the leading ends of the transfer sheets reach the fold-enforcing rollers 22 and 39. However, during fold-enforcing process of the fold-enforcing rollers 22 and 39, the amount by which the transfer sheets are conveyed is small. Accordingly, the fold-enforcing rollers 22 and 39 can be operated during the retaining operation to complete the fold-enforcing process. In such operation, the fold-enforcing process completes when conveyance of the transfer sheet is resumed. That is, the processing time can be shortened compared with the case where the fold-enforcing process is performed after the conveyance is resumed, and the total image forming process time can be shortened.

The above-described configuration can be used to fold a plurality of transfer sheets (for example, "n" transfer sheets) stacked one another by the registration roller pairs 16 and 33 functioning as the first retainers. In such a case, the sheet folding system 10 can fold a bundle of n transfer sheets as one job, and alternate the destination of conveyance of one job (the bundle of n transfer sheets) between the sheet folding apparatus 3 and the sheet folding apparatus 4 for each job. This configuration is described below.

The first transfer sheet is guided by the first bifurcating claw 12 occupying the first position and sent to the second conveyance passage F12. The first sheet is further guided by the second bifurcating claw 15 and the third bifurcating claw 17 occupying the respective first positions. When the trailing end of the first transfer sheet in the conveyance direction passes by the second bifurcating claw 15, the second bifurcating claw 15 moves to the second position, and the registration roller pair 16 is reversed. Then, the drawing-in roller pair 14 rotating in the forward direction sends the first transfer sheet to the drawing-in passage 60. After the trailing end of the transfer sheet in the conveyance direction passes through the drawing-in roller pair 14, the drawing-in roller pair 14 stops rotating, and then the transfer sheet is stored in the drawing-in passage 60.

The second to (n−1)th transfer sheets are conveyed to the drawing-in passage 60 similarly, and a bundle of transfer sheets (the number is n−1) is stacked therein. Thus, for example, the drawing-in passage 60 serves as a stacking area. When the first bifurcating claw 12 at the first position guides the nth transfer sheet to the second conveyance passage F12, the drawing-in roller pair 14 starts reverse rotation. The second bifurcating claw 15 at the second position guides the bundle of n−1 transfer sheets stored in the drawing-in passage 60 to the registration roller pair 16. The bundle of transfer sheets is retained with the leading end thereof in the conveyance direction abutting on the registration roller pair 16 that is not rotating.

Thereafter, the second bifurcating claw 15 moves from the second position to the first position, and the conveyance roller pair 13 guides the nth transfer sheet to the second bifurcating claw 15. The leading end of the nth transfer sheet in the conveyance direction is brought into contact with the registration roller pair 16, and the nth transfer sheet is retained there. Thereafter, at the similar timing as described above, the n transfer sheets retained are conveyed by the registration roller pair 16 and Z-folded by the same procedure.

After the n transfer sheets are sent to the sheet folding apparatus 3, a (n+1)th transfer sheet to a 2nth transfer sheet are sent to the sheet folding apparatus 4. The transfer sheets are stored in the drawing-in passage 61 through the same procedure as that in the sheet folding apparatus 3. When the 2nth transfer sheet is sent to the sheet folding apparatus 4, Z-folding is performed through the same procedure as that in the sheet folding apparatus 3. Thereafter, the folding process is performed in the same manner, and the bundle of folded transfer sheets is sent to the sheet post-processing apparatus 5.

As described above, by alternating the destination of conveyance between the sheet folding apparatus 3 and the sheet folding apparatus 4 for each job constructed of n transfer sheets, the same effect as the above embodiment can be attained. In this configuration, each of the registration roller pairs 16 and 33 functions as a stacker that stacks the transfer sheets one on another. In the sheet folding apparatus 3, for example, the conveyance roller pair 13, the drawing-in roller pair 14, the registration roller pair 16, the second conveyance passage F12, and the drawing-in passage 60 together construct a stacking portion.

In the embodiment described above, the transfer sheet conveyed from the sheet folding apparatus 3 to the sheet folding apparatus 4 has already been folded. Accordingly, the transfer sheet sent to the sheet folding apparatus 4 passes through the first conveyance passage F21, and the ejection roller pair 41 forwards the transfer sheet to the sheet post-processing apparatus 5.

Figure 11A:
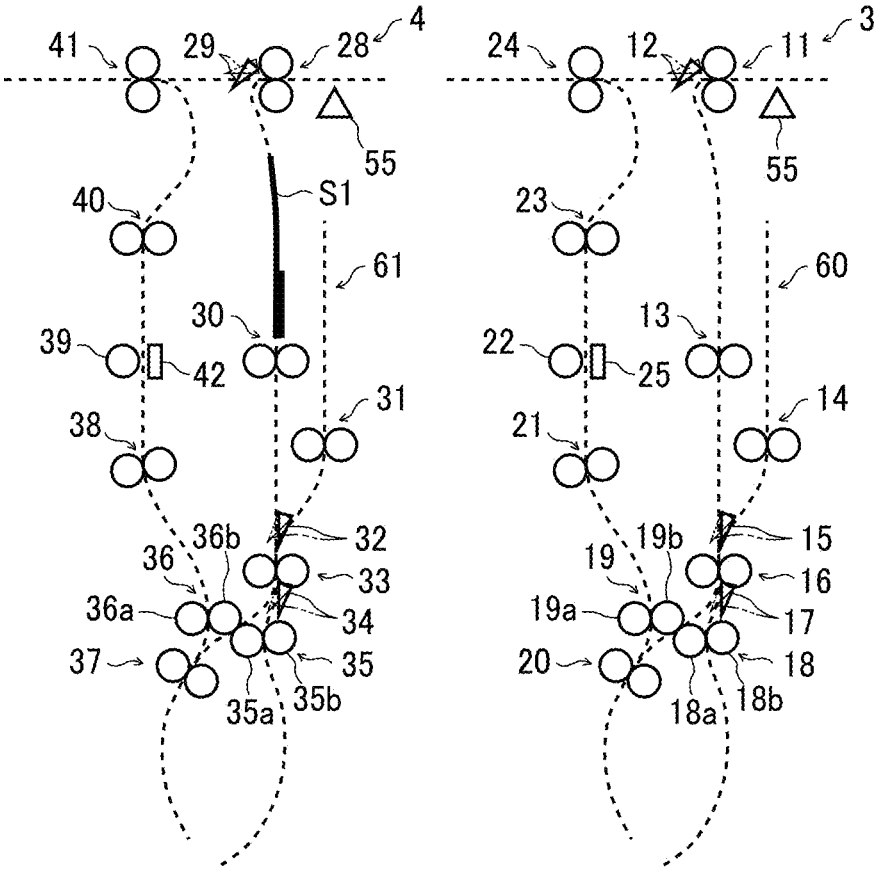
FIG. 11A is a schematic view illustrating sheet conveyance control according to another embodiment of the present disclosure.
Figure 11B:
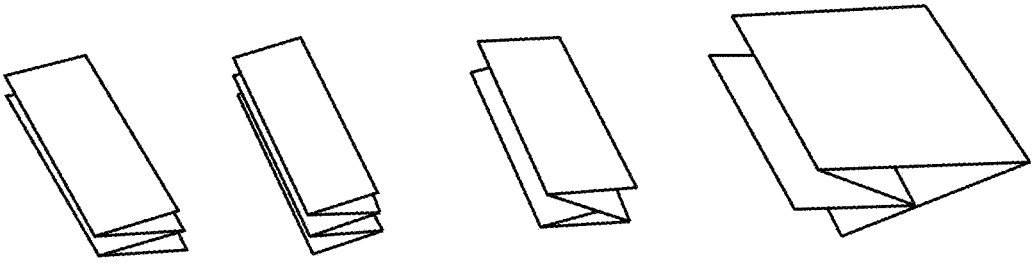
FIG. 11B is a schematic diagram illustrating an example of sheet folding process according to another embodiment of the present disclosure.

Therefore, as another embodiment of the present disclosure, as illustrated in FIGS. 11A and 11B, the sheet folding system 10 can be configured to send the transfer sheet 51 that has been Z-folded by the sheet folding apparatus 3 to the sheet folding apparatus 4 and further perform a variety of folding processes in the second conveyance passage F22, as illustrated in FIG. 11B.

With this configuration, the number of times of folding can be increased, and the types of folding can be increased to meet the needs of the user.

Additionally, a sheet folding apparatus similar to the sheet folding apparatuses 3 and 4 can be disposed at the subsequent stage of the sheet folding system 10 so that, after the transfer sheet is folded in the same manner as in the above-described embodiment, the folded transfer sheet is fed to the added sheet folding apparatus and folded therein. With this configuration, similarly, the number of times of folding can be increased, and the types of folding can be increased to meet the needs of the user.

In the above-described embodiment and modifications, the sheet folding system 10 includes two sheet folding apparatuses. Alternatively, the sheet folding system can include three or more sheet folding apparatuses. Use of at least two sheet folding apparatuses having an identical structure is advantageous in reducing the cost and improving maintainability.

In the above-described embodiments and modifications, the color copier is described as an example of the image forming apparatus 2, but the image forming apparatus 2 is not limited thereto. The present disclosure is adoptable to a printer, a facsimile machine, a multifunction peripheral (MFP), and monochrome machines. In the above-described embodiments, an image is formed on the transfer sheet S as a recording medium on which an image is formed. The transfer sheet S can be thick paper, a postcard, an envelope, plain paper, thin paper, coated paper (e.g., art paper), tracing paper, an overhead projector (OHP) transparency sheet (or OHP film), a resin film, and any other sheet-shaped material to bear an image and can be stapled.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The advantages achieved by the embodiments described above are examples and therefore are not limited to those described above.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A sheet folding system comprising:

a plurality of sheet folding apparatuses configured to receive and perform a folding process on sheets, each of the plurality of sheet folding apparatuses including:

a folding device configured to fold the sheet, a first conveyance passage configured to convey the sheets downstream in a sheet conveyance direction without passing through the folding device, a second conveyance passage configured to convey the sheets to the folding device, and a third conveyance passage configured to convey the sheets from the folding device downstream in the sheet conveyance direction; and circuitry configured to:

distribute the sheets to the plurality of sheet folding apparatuses, and control sheet conveyance to inhibit an interference, at a junction between the first conveyance passage and the third conveyance passage, between ones of the sheets conveyed from the first conveyance passage and ones of the sheets conveyed from the third conveyance passage by temporarily retaining at least one of the sheets within at least one of the second conveyance passage and the third conveyance passage.

2. The sheet folding system according to claim 1, wherein each of the plurality of sheet folding apparatuses includes at least one of a first retainer and a second retainer disposed in at least one of the second conveyance passage and the third conveyance passage, and wherein the circuitry is configured to cause the at least one of the first retainer and the second retainer to temporarily retain the sheet.

3. The sheet folding system according to claim 2, further comprising a stacking area leading from the first retainer, wherein the circuitry is configured to cause the first retainer to stack the sheet in the stacking area.

4. The sheet folding system according to claim 2, comprising, as the second retainer, a sheet conveyor configured to convey the sheet and disposed at extreme downstream in the third conveyance passage.

5. The sheet folding system according to claim 2, comprising, as the second retainer, a fold-enforcing device configured to enforce a fold on the sheet folded by the folding device.

6. The sheet folding system according to claim 2, further comprising a sheet detector on an upstream side in the first conveyance passage in the sheet conveyance direction, the sheet detector configured to detect the sheet, wherein the circuitry is configured to cancel retention of the sheet by the at least one of the first retainer and the second retainer in response to a signal from the sheet detector.

7. The sheet folding system according to claim 2, wherein the plurality of sheet folding apparatuses includes an upstream sheet folding apparatus and a downstream sheet folding apparatus disposed downstream from the upstream sheet folding apparatus in the sheet conveyance direction, and wherein the upstream sheet folding apparatus is configured to convey the sheet folded in the upstream sheet folding apparatus to the downstream sheet folding apparatus, and wherein the downstream sheet folding apparatus performs the folding process on the folded sheet.

8. The sheet folding system according to claim 1, wherein at least two of the plurality of sheet folding apparatuses have an identical structure.

9. The sheet folding system according to claim 1, wherein the respective first conveyance passages of the plurality of sheet folding apparatuses are connected in series.

10. An image forming system comprising:

an image forming apparatus configured to form an image on a sheet; and the sheet folding system according to claim 1, configured to perform the folding process on the sheet on which the image is formed.

11. A first sheet folding apparatus, comprising:

a folding device configured to fold sheets;

a first conveyance passage configured to convey the sheets downstream in a sheet conveyance direction without passing through the folding device;

a second conveyance passage configured to convey the sheets to the folding device;

a third conveyance passage configured to convey the sheets from the folding device downstream in the sheet conveyance direction; and circuitry configured to:

distribute the sheets to the first sheet folding apparatus and a second sheet folding apparatus connected thereto, and control sheet conveyance to inhibit an interference, at a junction between the first conveyance passage and the third conveyance passage, between ones of the sheets conveyed from the first conveyance passage and ones of the sheets conveyed from the third conveyance passage by temporarily retaining at least one of the sheets within at least one of the second conveyance passage and the third conveyance passage.

12. The first sheet folding apparatus according to claim 11, wherein a portion of at least one of the second conveyance passage and the third conveyance passage is configured as a retainer, and the circuitry is configured to control the sheet conveyance such that the at least one of the sheet is temporarily retained by the retainer.

13. A method of operating a sheet folding system including a plurality of sheet folding apparatuses configured to receive and perform a folding process on sheets, the plurality of sheet folding apparatuses each including a folding device configured to fold the sheets, a first conveyance passage configured to convey the sheets downstream in a sheet conveyance direction without passing through the folding device, a second conveyance passage configured to convey the sheets to the folding device and a third conveyance passage configured to convey the sheets from the folding device downstream in the sheet conveyance direction, the method comprising:

distribute the sheets to the plurality of sheet folding apparatuses; and control sheet conveyance to inhibit an interference, at a junction between the first conveyance passage and the third conveyance passage, between ones of the sheets conveyed from the first conveyance passage and ones of the sheets conveyed from the third conveyance passage by temporarily retaining at least one of the sheets within at least one of the second conveyance passage and the third conveyance passage.

14. The method of operating the sheet folding system according to claim 13, wherein a portion of at least one of the second conveyance passage and the third conveyance passage is configured as a retainer, and the controlling controls the sheet conveyance such that the at least one of the sheet is temporarily retained by the retainer.

* * * * *